US007617641B2

(12) United States Patent
Landey

(10) Patent No.: US 7,617,641 B2
(45) Date of Patent: Nov. 17, 2009

(54) ATTIC FLOOR JOIST GRID SYSTEM FOR WEIGHT BEARING STORAGE

(76) Inventor: Arlan H. Landey, 929 Myers Ave., Anderson, IN (US) 46012

( * ) Notice: Subject to any disclaimer, the term of this patent is extended or adjusted under 35 U.S.C. 154(b) by 696 days.

(21) Appl. No.: 11/232,838

(22) Filed: Sep. 22, 2005

(65) Prior Publication Data

US 2006/0075711 A1 Apr. 13, 2006

Related U.S. Application Data

(60) Provisional application No. 60/612,329, filed on Sep. 23, 2004.

(51) Int. Cl.
*E04C 2/42* (2006.01)

(52) U.S. Cl. ..... 52/177; 52/179; 52/180; 52/302.1; 52/664

(58) Field of Classification Search ..... 52/177, 52/179, 180, 302.1, 664; 404/36; 119/529
See application file for complete search history.

(56) References Cited

U.S. PATENT DOCUMENTS 1,457,909 A * 6/1923 Lloyd ..... 52/506.05
2,607,301 A * 8/1952 Lundvall ..... 52/664
2,689,366 A * 9/1954 Wichert ..... 52/180
3,410,546 A * 11/1968 Daringer et al. ..... 220/485
5,406,895 A * 4/1995 Suess ..... 211/86.01
2005/0016098 A1 * 1/2005 Hahn ..... 52/384

* cited by examiner

*Primary Examiner*—Richard E Chilcot, Jr.
*Assistant Examiner*—Matthew J Smith
(74) *Attorney, Agent, or Firm*—Ritchison Law Offices, PC; John D Ritchison

(57) ABSTRACT

An Attic Floor Joist Grid System for Weight Bearing Storage called an Attic Grid System. This system features low profile, flat, open and high strength grid panels that are supported by a joist system. The panels install directly onto the ceiling joists in an attic or storage area for residential and commercial applications. The panels are nominal widths that extend essentially to the center points of supporting joists. The system provides a simple and strong support surfaces which only requires simple, easy to use tools for installation. The panels are easily trimmed to size for non-standard operations and for encircling mechanical and electrical objects. The system is "see-through" and permits full air movement. Hence it does not contribute to moisture entrapment, mold and mildew. The materials are fire resistant and do not collapse or emit toxic fumes in the presence of a flame.

2 Claims, 8 Drawing Sheets

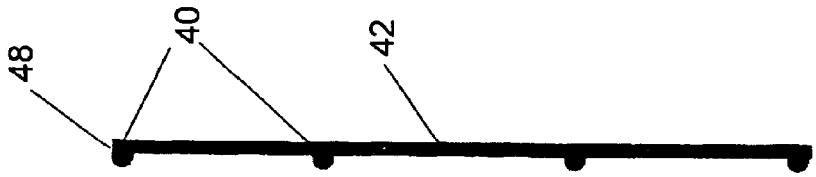
Fig. 2B
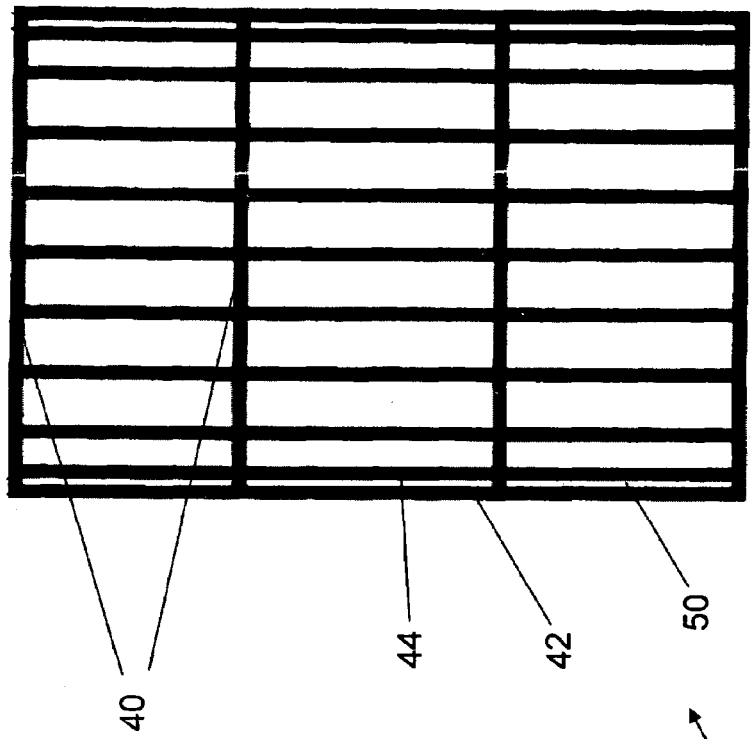
Fig. 2A
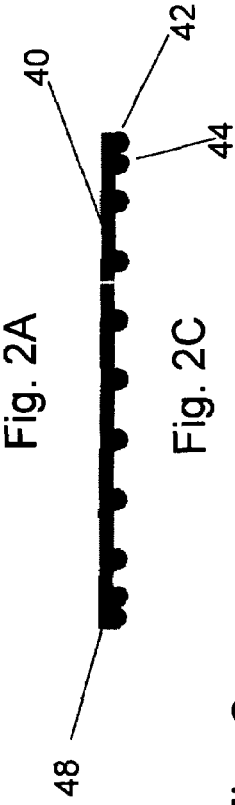
Fig. 2C
31
Fig. 2

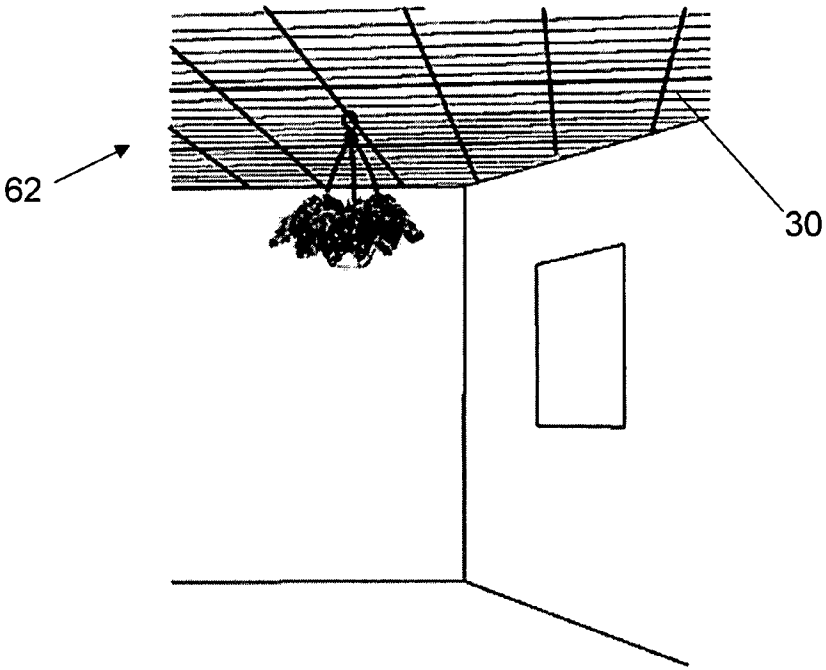
Fig. 8B
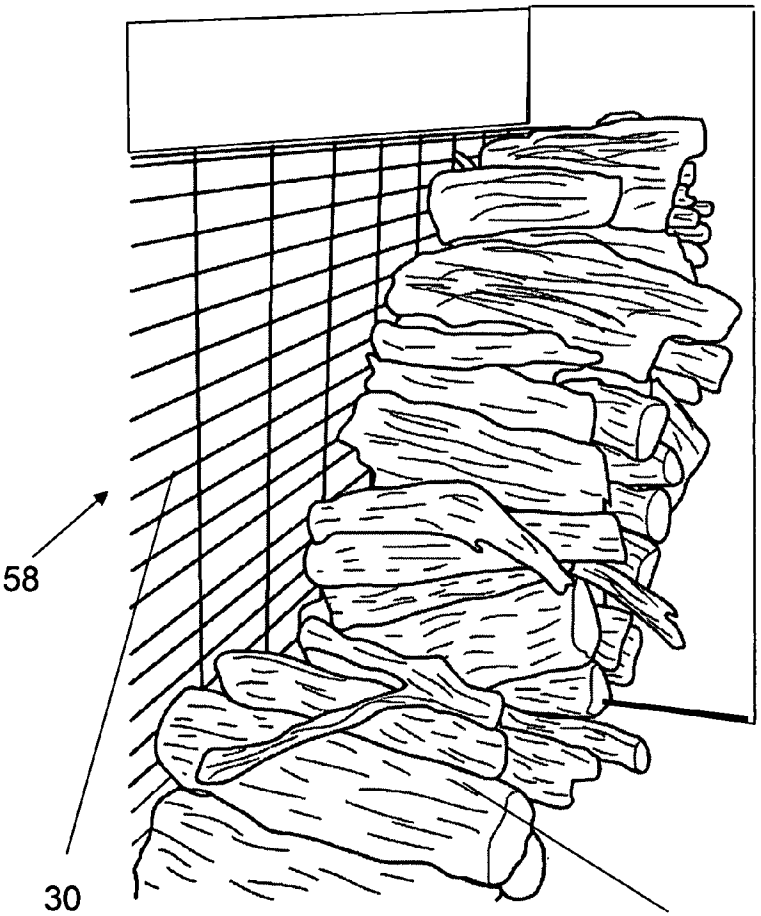
Fig. 8A
Fig. 8

ATTIC FLOOR JOIST GRID SYSTEM FOR WEIGHT BEARING STORAGE

CROSS-REFERENCE TO RELATED APPLICATIONS

This application claims the benefit of Provisional Patent Application Ser. No. 60/612,329 filed Sep. 23, 2004 by Arlan H. Landey and titled "Attic Floor Joist Grid System for Weight Bearing Storage".

FIELD OF INVENTION

The present device and building system, an Attic Floor Joist Grid System for Weight Bearing Storage (Attic Grid System) relate to the field of flooring in order to create a grid support system on the supporting joists of an attic and other joist supported areas in commercial and residential buildings. This new use for a support plane is a system which installs the support plane directly onto the ceiling joists in an attic or storage area. The plane is a low profile, high strength device that permits a person of limited training to quickly install a support floor or other planar mechanism which have high strength capacities and require simple, easy to use tools for installation. This system is useful for residential and commercial applications in storage areas above joists. It also has several unique alternative uses described in the below specification.

FEDERALLY SPONSORED RESEARCH

Not Applicable.

SEQUENCE LISTING OR PROGRAM

Not Applicable

BACKGROUND-FIELD OF INVENTION

The new Attic Grid System in this specification is a device and system which is designed to easily and quickly install on standard joist supports for a work surface and which allow the Attic Grid System to augment and increase the storage capacity or protection of the work surface for the standard joist supports.

A. Introduction of the Problems Addressed

Consumers often use various items in an attempt to achieve a safe method for walking or crawling in an attic area. These include scrap lumber and scrap plywood among other items . . . The problem with these items is that sometimes the scrap plywood is too large and necessitates cutting to fit through an attic opening. In addition, scrap materials used by well-intentioned consumers may be of varying edge dimension which in turn creates a danger for tripping by persons traversing the attic and other storage areas. Consumers are sometimes unaware of the risks involved in capturing moisture on an attic floor. Absent this awareness, they may inadvertently cover an attic area with materials that potentially may result in dry-rot or severe mildew and mold growth as a result of not permitting the floor and insulation to "breathe". These problems are addressed and remedied with this present invention, the Attic Grid System, by providing a simple, uniform product and system that is easy to install and prevents trapping moisture that may lead to dry-rot or mildew and mold growth.

B. Prior Art

Historically, storage and floor systems have not addressed the need for uniform, low profile surfaces that permit air circulation to prevent mold, mildew and dry-rot. For both residential and commercial use of areas above ceiling joists, few devices were available to permit easy storage areas to be configured. In use, the prior art devices were often complex, cumbersome and difficult to install and very specific and limited in storage use. Most installations were special design and custom made. In addition, some of the storage required sophisticated installation and complex measuring in order to install some of these devices properly. The new Attic Grid System addresses these limitations and provides a solution to the stated problems.

Examples of prior auxiliary mechanisms for flat support devices or the like begin with U.S. Pat. No. 107,171 issued to Frick (1870). This teaches a low profile wire mesh which was used to filter coal. No mention of use as a primary or secondary floor surface was mentioned. Another invention did teach an open floor. This was issued to Wichert as a U.S. Pat. No. 2,689,366 (1954). It teaches a complex, inter-connected flooring system created by various bars and plates interconnected in a lattice pattern. The device included deep projections of the support ribs in various sizes and configurations. The device was thicker than the profile established with an Attic Grid System.

Other examples include a U.S. Pat. No. 4,329,939 issued to Christie (1982) which teaches a raised flooring unit for use with animal stalls and the like. The device uses broken steel sheets to create the structure with enough strength to hold the animals. Again the device taught is a thicker profile than that taught in the Attic Grid System. A U.S. Pat. No. 4,362,128 issued to Downey (1982) teaches another animal flooring device for livestock care and containment. The device is a deep configuration that is an independent structure which raises the floor off the ground in a pen or barn. No joist support is described. These are merely laid directly on the subsurface to allow moisture, food and fecal matter to be away from the animals.

Another flooring unit is taught in U.S. Pat. No. 4,953,501 and was issued to Moreau (1990). It teaches an open mat for use with animals, again to permit moisture and waste to drop below where the animals stay. No use as a storage surface on joist is taught or implied.

A roof truss storage shelf is taught in U.S. Pat. No. 5,406,895 issued to Suess (1995). This shelf is held to the truss members by "J" clips that fasten to the truss members. The shelf then hangs well above the truss chord. No mention of use direct to the joist is shown or specified. A U.S. Pat. No. 6,202,355 issued toe Uram et al. (2001) was focused at a flat, retractable cover that provided rigid panels or grates. These panels were retractable, yet when extended the top surface provided a load bearing surface for dancing, sporting events and the like. Attic support surfaces were not taught in the specifications or drawings.

A building with an attic module system affixed to rails is taught in U.S. Pat. No. 6,341,468. This was issued to Bigelow (2002). This taught a storage unit which was above the joists on a rail system. Surface support direct to the joist was not mentioned. An overhead storage module is taught by two U.S. Patents issued to Nott et al. U.S. Pat. No. 6,354,682 (2002) and U.S. Pat. No. 6,357,842 (2002) both show storage modules which hang below the ceiling joists and provide a closed compartment. Each are hinged downwardly under the ceiling and teach no attic use.

A U.S. Pat. No. 397,457 (1998) issued to Hutchings shows a flooring unit with interlocking protrusions along the edges.

Uses are not described since it is a design, not utility, patent. The configuration appears to be a much deeper profile as compared to the Attic Grid System. Another U.S. Pat. No.433,165 issued to Moreau et al demonstrate a panel for animal housings. The sides again appear deeper than the Attic Grid System and show what may be an interlocking design of protrusions and recesses along the sides of the panel.

A recent device for attic flooring or deck is taught in U.S. Publication U.S. 2005/00169098 A1 by Hahn. The configuration bears a close resemblance to the Design patents by Hutchings and Moreau, above, yet is a utility patent application. The Hahn publication teaches an interlocking, deeper profile when compared to the Attic Grid System. The unit teaches down tabs to hold in place with the joists. The overall lateral dimension runs to the full width of a joist system, not to centerlines. This full with in conjunction with the down tabs present a susceptibility to any minor variations in joist spacing and necessitates extra cutting and fitting for narrow joist or extra wide joist spacing. Additionally, where fitting is required around electrical and mechanical objects in the attic area, the protrusions and recesses taught will not permit as tight of configuration to the objects. Alignment of the protrusions and recesses will cause further delay in alignment around objects and may require extensive trimming with special tools.

Additional discussion of the Hahn teaching is merited. The panels are described as formed units and appear to be molded plastic or cast metal. The depth and configuration diminishes a "see-through" capability as well as air circulation. One alternative even teaches a solid floor which is fraught with ventilation concerns and moisture entrapment. The plastic system will be susceptible to burning, melting and toxic emissions if engaged by a residential or commercial fire in an enclosed space such as an attic. This does not happen with an Attic Grid System. Further, depending on the materials, this design may not be environmentally recyclable.

None of the prior art found or described above teaches all the features and capabilities of the Attic Grid System.

SUMMARY OF THE INVENTION

This invention is an auxiliary mechanism for an Attic Floor Joist Grid System for Weight Bearing Storage called an Attic Grid System. This device and system feature low profile flat, open and high strength grid planes to enable a person to provide simple and strong support surfaces which are in turn supported by a joist system. These Attic Grid Systems featured with a thin, strong planar device permit a person to quickly install and provide storage capacity in residential and commercial buildings. Alternative uses permit other storage and protective means which are described in the specification, below. The device and system have various simple means to attach to the support joists.

OBJECTS AND ADVANTAGES

Accordingly, there are several objects and advantages of the Attic Grid System. There currently exist only a few attic deck devices which have extensive complexity and limitations. This Attic Grid System provides improvement because it is designed to be used easily used in residential and commercial settings.

One specific improvement is that this Attic Grid System provides a light-weight, low profile and high strength load bearing joist grid system for attics (residential, outbuilding, commercial) that is very thin and is a high strength uniform grid that is easily adapted to whatever joist system is present. This lightweight lattice provides a distinct alternative to thicker and more complex devices as well as an alternative to heavy, large-dimension sheathing that must be cut to fit through small attic access doors.

Another added improvement is the ease of fabrication and installation for the Attic Grid System. Essentially no fabrication is required for installation. Normally little or no cutting is needed into the existing structural components (joists, ceilings, etc) for installation. Simple tools are used and no special mechanical apparatus is used which might break-down and require special maintenance. Module grids may include Pre-Cut (16" on Center and 24" on Center) for immediate installation in Garages and Residential retrofit (and new construction) and larger Pre-Cut (Custom Widths/Lengths) for Commercial/Industrial/Agricultural Buildings.

Another improvement is the open lattice design permits a pass-through for building generated moisture migration. This prevents moisture entrapment and potential mold, mildew and eventual dry-rot. The open design provides a means for attic storage and commercial (Mezzanine) storage while allowing moisture migration through the fiberglass insulation placed between the joists that might otherwise gather beneath a solid floor thereby creating a situation for dry-rot to occur. Grid Spacing of Attic Grid System prevents collection of dirt and dust. When installed in an attic or other application, the preferred circular wire and grid prevents the product from "pooling" liquids on the top surface from condensation or from other leaks. Other designs have inherent trappings of condensate and moisture.

Importantly, this same open configuration permits an easy see though feature to view the surrounding electrical and mechanical connections often found in the attic areas. The grid system does not inhibit visual inspection of insulation, wiring, ducting or joists that may be found immediately beneath grid.

A further enhancement is this more versatile design over traditional systems is that it provides a consistent surface that will safely store numerous objects of varying weights and dimensions without danger of sagging, breaking, and crashing through the ceiling below the joist area.

Other features permitted by this low profile, high strength configuration is surface treatment and powder coating on the Attic Grid System to inhibit rust and corrosion. Once installed, no additional painting or maintenance is required. The pre-paint preparation and chemical process eliminates rust and creates a no-peel surface. Airborne impurities will not compromise the manufactured coating. Highly pure environments for say farming needs (milk production, egg production, etc.) may be attained since "ground in" dirt and contaminants may be wiped clean and provide a Grade A standard environment.

Environmentally, the Attic Grid System use entirely non-toxic/non-carcinogenic materials. The product is completely re-cyclable. These Attic Grid System products do not out-gas (plastic products outgas continuously). Likewise, the products are not affected by invisible spectrum waves/light (ultra violet/infra red) which is the cause for splits, tears, fading, cracking, peeling, etc. in plastic and fabric Products.

One other feature is that the Attic Grid System has no sharp edges or burring that might cause damage to stored goods and cause injury during installation.

Of extreme importance is that the preferred embodiment for the Attic Grid System features an high strength metal wire structure. This provides a non-burnable structure as opposed to petroleum based plastics and the like. This metal structure resists burning or collapsing from a melt-down. Additionally, the metal will not create a toxic fumes and smoke condition if a structure with the flooring catches fire. Attic Grid System does not become brittle or break when exposed to extreme cold conditions and the Attic Grid System does not deteriorate strength and flex or sag when exposed to extreme heat.

Finally, other advantages and additional features of the present Attic Grid System will be more apparent from the accompanying drawings and from the full description of the device. For one skilled in the art of devices and improvements for storage devices, it is readily understood that the features shown in the examples with this mechanism are readily adapted to other types of grid floor systems and improvements.

DESCRIPTION OF THE DRAWINGS—FIGURES

The accompanying drawings, which are incorporated in and constitute a part of this specification, illustrate an embodiment of the Attic Grid System that is preferred. The drawings together with the summary description given above and a detailed description given below serve to explain the principles of the Attic Grid System. It is understood, however, that the Attic Grid System is not limited to only the precise arrangements and instrumentalities shown.

FIG. 2 is sketch of a nominal sixteen inch (16" On Center [O.C.] wide by 24" long) Attic Grid System plane with three directional views.

FIG. 8 are photographs of alternative uses for an Attic Grid System.

DESCRIPTION OF THE DRAWINGS—REFERENCE NUMERALS

Figure 1:
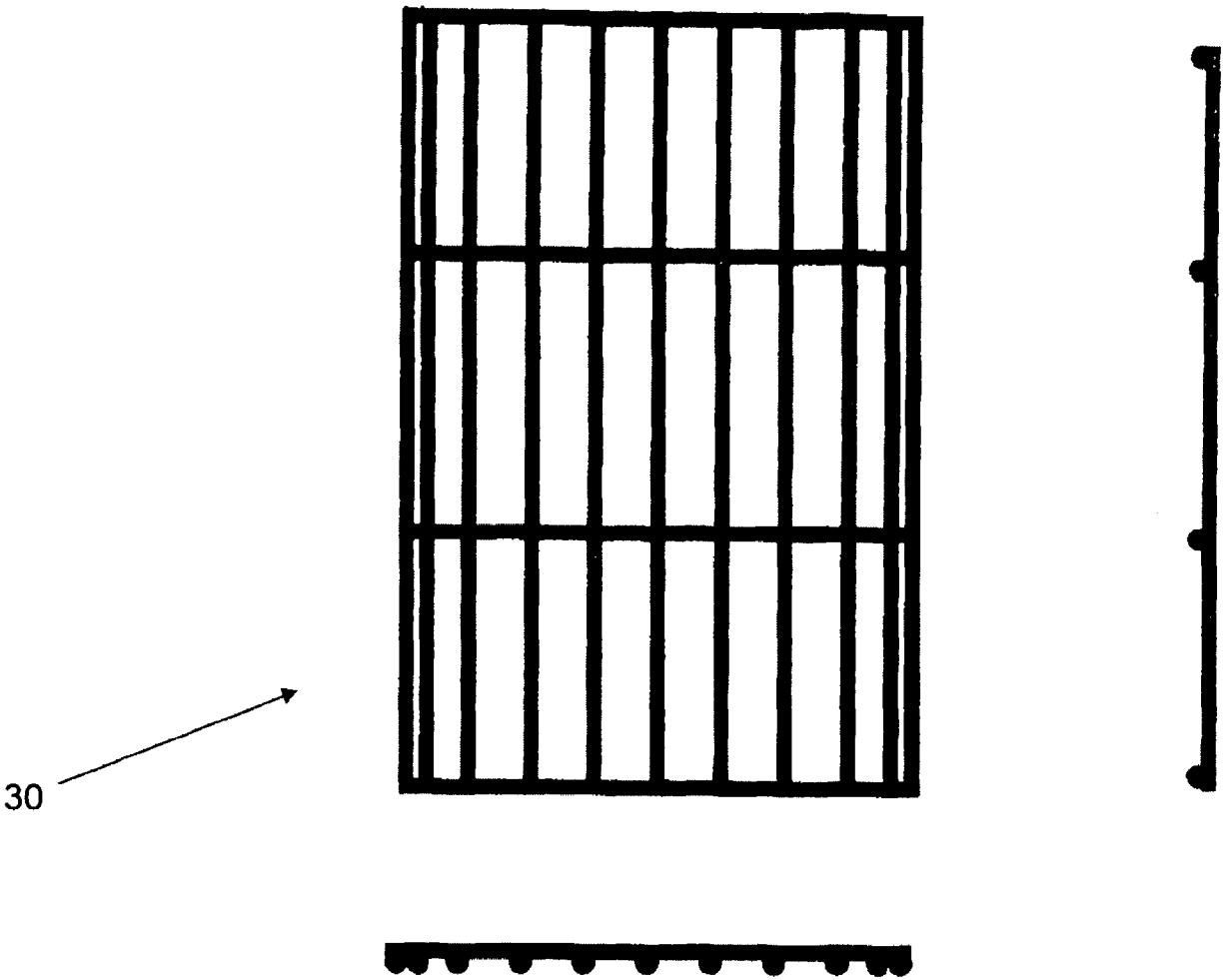
FIG. 1 is a general sketch of the invention—an Attic Grid System.

The following list refers to the drawings:

| | |
|---|---|
| 30 | general Attic Grid System |
| 31 | typical 16 inch by 24 inch Attic Grid System |
| 33 | typical 16 inch by 48 inch Attic Grid System |
| 35 | typical 24 inch by 24 inch Attic Grid System |
| 37 | typical 24 inch by 48 inch Attic Grid System |
| 39 | typical 48 inch by 48 inch Attic Grid System |
| 40 | lateral primary bearing structure |
| 42 | longitudinal primary bearing structure |
| 44 | longitudinal secondary bearing structure |
| 46 | fastener of Attic Grid System to joist means |
| 48 | connection of bearing structure means |
| 50 | aperture between longitudinal bearing structures 42 and |
| 52 | typical support joists |
| 54 | insulation fill |
| 56 | ceiling below joist |
| 58 | an alternative for an Attic Grid System use as a sidewall protector |
| 60 | heavy material near a sidewall |
| 62 | an alternative for Attic Grid System use as a ceiling |

DETAILED DESCRIPTION OF PREFERRED EMBODIMENT

The present invention is an Attic Floor Joist Grid System for Weight Bearing Storage called an Attic Grid System for Weight Bearing Storage (Attic Grid System). The system relates to flooring in order to create a grid support system on the supporting joists of an attic in commercial and residential buildings. This new use for a support plane is a system which installs the support plane directly onto the top of ceiling joists. The support plane is a low profile, high strength device that permits a person of limited training to quickly install a support floor or other planar mechanism. The system results in a flooring structure which has high strength capacities. Installation, described below, is done with simple, easy to use tools. While the preferred embodiment is a system useful for residential and commercial applications in storage areas above joists, the configuration has several unique alternative uses described below.

The improvement over the existing art is providing a device that provides a light-weight, low profile and high strength load bearing joist grid system for attics; that has ease of fabrication and installation; that has the open lattice design which permits a pass-through for building generated moisture migration; that permits an easy see though feature to view the surrounding electrical and mechanical connections; that is a more versatile design over traditional systems; that provides a consistent surface; that has surface treatment and powder coating; that uses entirely non-toxic/non-carcinogenic materials; that has no sharp edges or burring that might cause damage to stored goods and cause injury during installation; and, that provides a non-burnable structure as opposed to petroleum based plastics and the like.

There is shown in FIGS. 1-8 a complete operative embodiment of the Attic Grid System. The Attic Grid System generally relates to an Attic Floor Joist Grid System for Weight Bearing Storage device and system for providing additional storage in residential and commercial buildings. In the drawings and illustrations, note well that the FIGS. 1-8 demonstrate the general condition of the preferred embodiment of the device which is comprised of only a few parts. These parts include, but are not limited to, the Attic Grid System 30 comprised normally of a lateral bearing structure 40, a longitudinal bearing structure 42 and a secondary longitudinal bearing structure 44 which are all fixably attached together by a fastening or fabrication means. Various important features of these structures and means to attach are delineated in FIG. 1-8 of the drawings and are described below in appropriate detail. One skilled in the art of support mechanisms and systems appreciates their importance and functionality to the Attic Grid System. The examples illustrate embodiments of the invention, in several forms, and such examples are not to be construed as limiting the spirit and scope of the invention in any manner.

FIG. 1 is a general sketch of the invention—an Attic Grid System. It shows the general configuration and views of the Attic Grid System 30 without describing the features and parts of which it is comprised.

FIG. 2 are sketches of a nominal sixteen inch (essentially 16" On Center [O.C.] wide by 24" long) Attic Grid System plane 31 with three directional views. FIG. 2A is a top view showing the lateral primary bearing structures 40 fixably attached to the longitudinal primary bearing structure 42 and the longitudinal secondary bearing structure 44. The means to attach 48 depends on the structure materials of the bearing structures 40, 42 and 44 and is further discussed herein once the general configuration is described. One should note that the placement of the longitudinal primary bearing structure 42 and longitudinal secondary bearing structure 44 onto the lateral primary bearing structures 40 results in a comparatively small space or aperture 50. One should also note that the configurations of all the bearing structures 40, 42 and 44 results in an open web design that freely permits airflow in the storage are and does not entrap moisture. FIG. 2B is a side view and FIG. 2C is an end view of the same nominal sixteen inch (essentially 16" On Center [O.C.] wide by 24" long) Attic Grid System plane 31 described from the top view. The configuration and description of the referenced numbers is the same.

The preferred materials for the bearing structures 40, 42 and 44 is a five gage, high strength alloy steel wire with a powder coated surface treatment. These wires would ideally be connected by a means 48 such as spot welding, then deburred and powder coated as a rectangular shaped Attic Grid System 30. While this is the preferred system, one skilled in the art recognized the plethora of other ways to assemble, form or fabricate a high strength, low profile plane that may serve the scope and spirit of this Attic Grid System 30. TABLE A illustrates many of these possibilities. The list is exemplary and not exhaustive and limiting to the invention presents herein.

TABLE A

EXAMPLES OF ALTERNATIVE MATERIALS

| ITEM | DESCRIPTION | COMMENTS |
|---|---|---|
| 1 | Cold Rolled Steel Wire | Various Chemistries and Gauges |
| 2 | Hot Rolled Steel Wire | Various Chemistries and Gauges |
| 3 | Hot Rolled Pickled Steel Wire | Various Chemistries and Gauges |
| 4 | Galvanized Steel Wire | Various Chemistries and Gauges |
| 5 | Galvannealed Steel Wire | Various Chemistries and Gauges |
| 6 | Galvalume Steel Wire | Various Chemistries and Gauges |
| 7 | Electro galvanized Steel Wire | Various Chemistries and Gauges |
| 8 | Aluminized Steel Wire | Various Chemistries and Gauges |
| 9 | Stainless Steel Wire | Various Chemistries and Gauges |
| 10 | Wire made from other Ferrous Metals | Various Chemistries and Gauges |
| 11 | Narrow-Slit Metal Bands | |
| 12 | "Mail Net" type of Flexible-Woven Materials | made from various metals |
| 13 | Rectangular or Cylindrical Steel Tubular Products | Various Chemistries and Gauges |
| 14 | Composition Materials | With particular resistance to fire and moisture |
| 15 | Various Petroleum Based Products | w/additives designed for fire and moisture resistance |
| 16 | Various Wood Products | w/additives designed for fire and moisture resistance |
| 17 | Various Mineral Based Products | w/additives designed for fire and moisture resistance |
| 18 | Glass and non-glass filled resin materials | w/additives designed for fire and moisture resistance |

With the preferred materials and alternatives described for the bearing structures 40, 42 and 44, it is appropriate to consider a few examples and illustrations of the means to connect 48 the bearing structures 40, 42 and 44. The preferred method stated above is by spot welding, then powder coating the assembly as a rectangular shaped Attic Grid System 30. While this is the preferred system, one skilled in the art recognizes the many other ways to attach, form or fabricate the assembly. The result would still be a high strength, low profile plane that may well serve the scope and spirit of this Attic Grid System 30. TABLE B illustrates many of these possibilities. The list is exemplary and not exhaustive and limiting to the invention presents herein.

TABLE B

EXAMPLES OF MEANS TO CONNECT 48

| ITEM | DESCRIPTION | COMMENTS |
|---|---|---|
| 1 | Utilization of Snap-in Clips | |
| 2 | Utilizing a system of "binding" | Heat Activated molecular bond or mechanically activated Compression bond |
| 3 | Adhesives and gluing | |
| 4 | Brazing | |
| 5 | Wrapping with wire | |
| 6 | Weaving the materials into a lattice | |
| 7 | Metal Casting | For metals |
| 8 | Punching into the configuration | For sheet materials |
| 9 | Molding | For plastics and composites |

Figure 3:
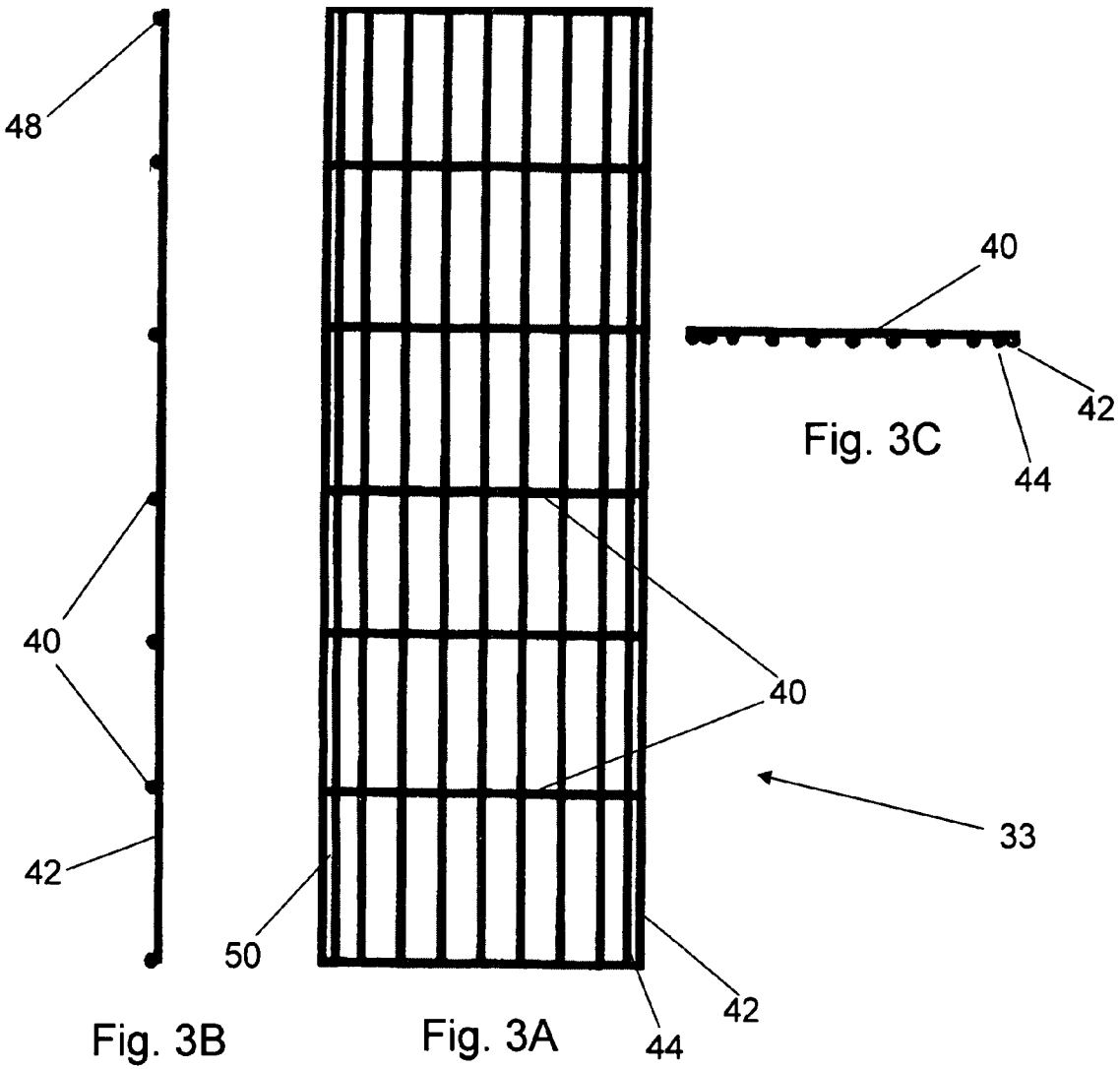
FIG. 3 is a sketch of a nominal sixteen inch (16" O.C. wide by 48" long) Attic Grid System plane with three directional views.

The FIG. 3 are sketches of a nominal sixteen inch (essentially 16" On Center [O.C.] wide by 48" long) Attic Grid System plane 33 with three directional views. FIG. 3A is a view, FIG. 3B is a side view, and FIG. 3C is an end view top same Attic Grid System plane 33. The configuration and description of the referenced numbers in the drawings is the same as described in the paragraphs above for the Attic Grid System plane 31. Likewise the materials, coatings and attachment means are the same as described above for the other nominal sizes. One skilled in the art appreciates that these sizes are for illustration and not a limitation to the spirit and scope of the Attic Grid System 30.

Figure 4:
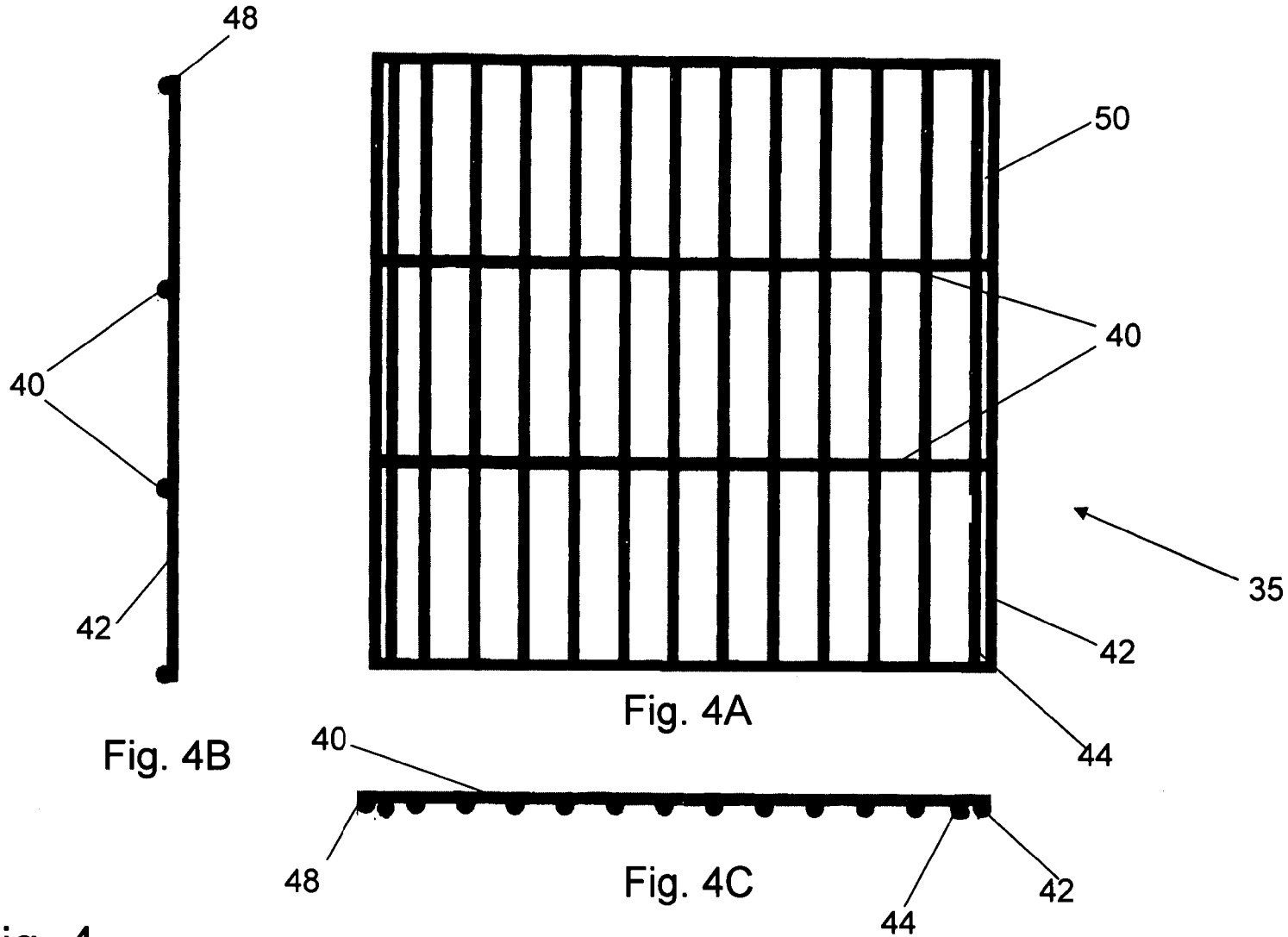
FIG. 4 is a sketch of a nominal twenty four inch (24" O.C. wide by 24" long) Attic Grid System plane with three directional views.

The FIG. 4 are sketches of a nominal twenty four inch (essentially 24" On Center [O.C.] wide by 24" long) Attic Grid System plane 35 with three directional views. FIG. 4A is a top view, FIG. 4B is a side view, and FIG. 4C is an end view of the same Attic Grid System plane 35. The configuration and description of the referenced numbers in the drawings is the same as described in the paragraphs above for the Attic Grid System plane 31. Similarly, the materials, coatings and attachment means are the same as described above for the other nominal sizes. One skilled in the art appreciates that these sizes are for illustration and not a limitation to the spirit and scope of the Attic Grid System 30.

Figure 5:
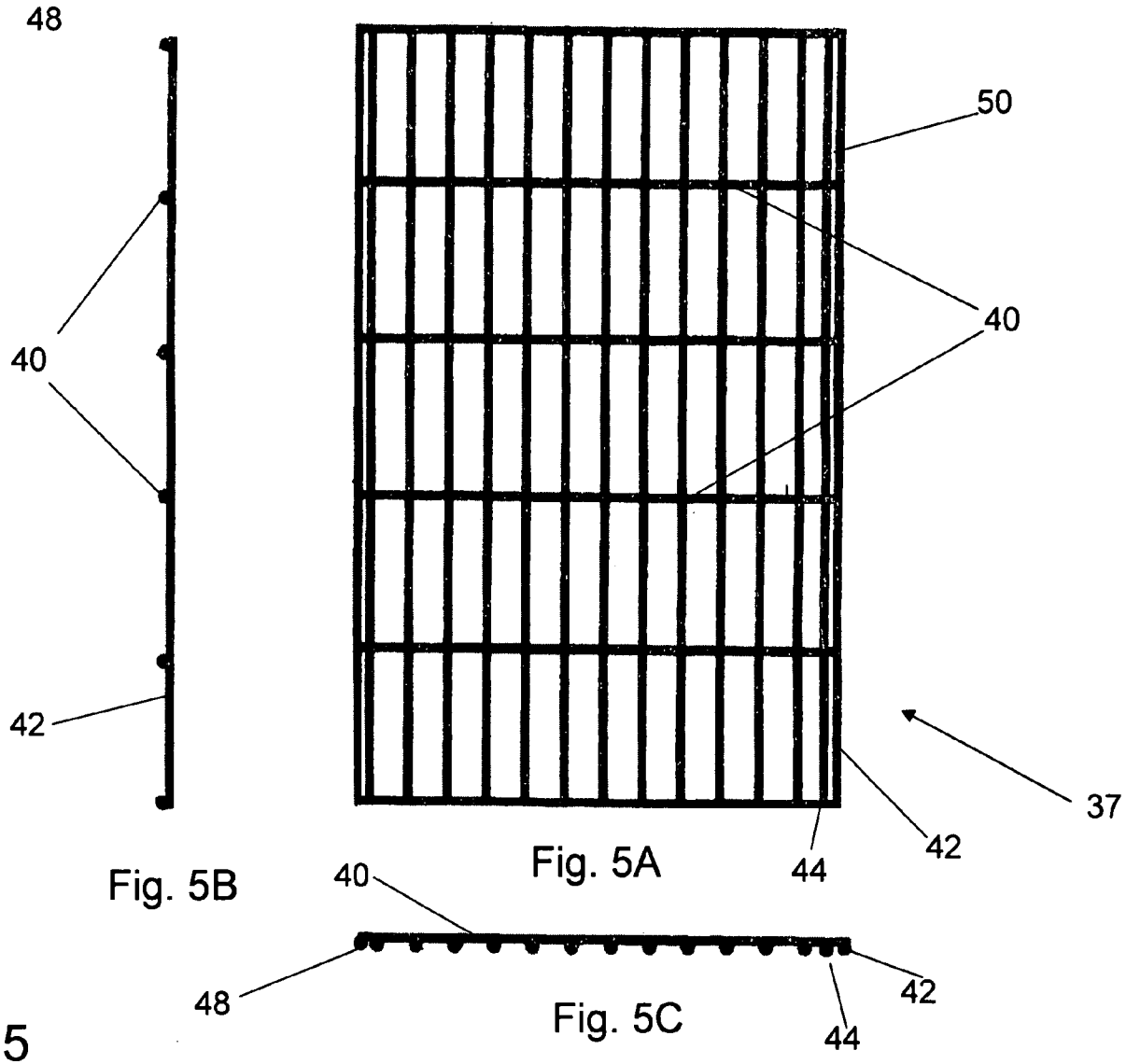
FIG. 5 is a sketch of a nominal twenty four inch (24" O.C. wide by 48" long) Attic Grid System plane with three directional views.

The FIG. 5 are sketches of a nominal twenty four inch (essentially 24" On Center [O.C.] wide by 48" long) Attic Grid System plane 37 with three directional views. FIG. 5A is a top view, FIG. 5B is a side view, and FIG. 5C is an end view of the same Attic Grid System plane 37. The configuration and description of the referenced numbers in the drawings is the same as described in the paragraphs above for the Attic Grid System plane 31. Likewise the materials, coatings and attachment means are the same as described above for the other nominal sizes. One skilled in the art appreciates that these sizes are for illustration and not a limitation to the spirit and scope of the Attic Grid System 30.

Figure 6:
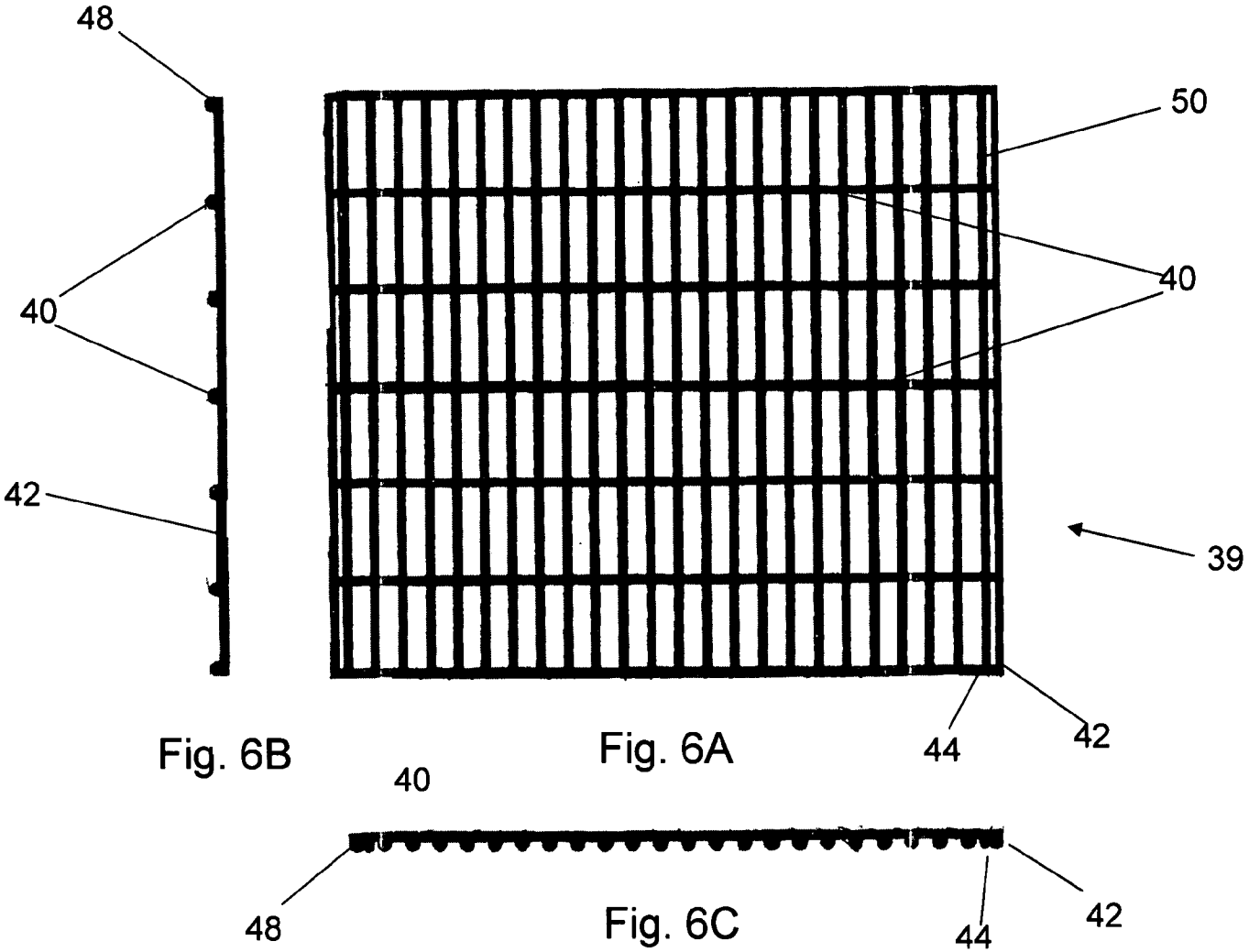
FIG. 6 is a sketch of a typical forty-eight (48" wide by 48" long) Attic Grid System plane with three directional views.

The FIG. 6 are sketches of a nominal forty eight inch (essentially 48" wide by 48" long) Attic Grid System plane 39 with three directional views. FIG. 6A is a top view, FIG. 6B is a side view, and FIG. 6C is an end view of the same Attic Grid System plane 39. The configuration and description of the referenced numbers in the drawings is the same as described in the paragraphs above for the Attic Grid System plane 31. Likewise the materials, coatings and attachment means are the same as described above for the other nominal sizes. One skilled in the art appreciates that these sizes are for illustration and not a limitation to the spirit and scope of the Attic Grid System 30.

Figure 7:
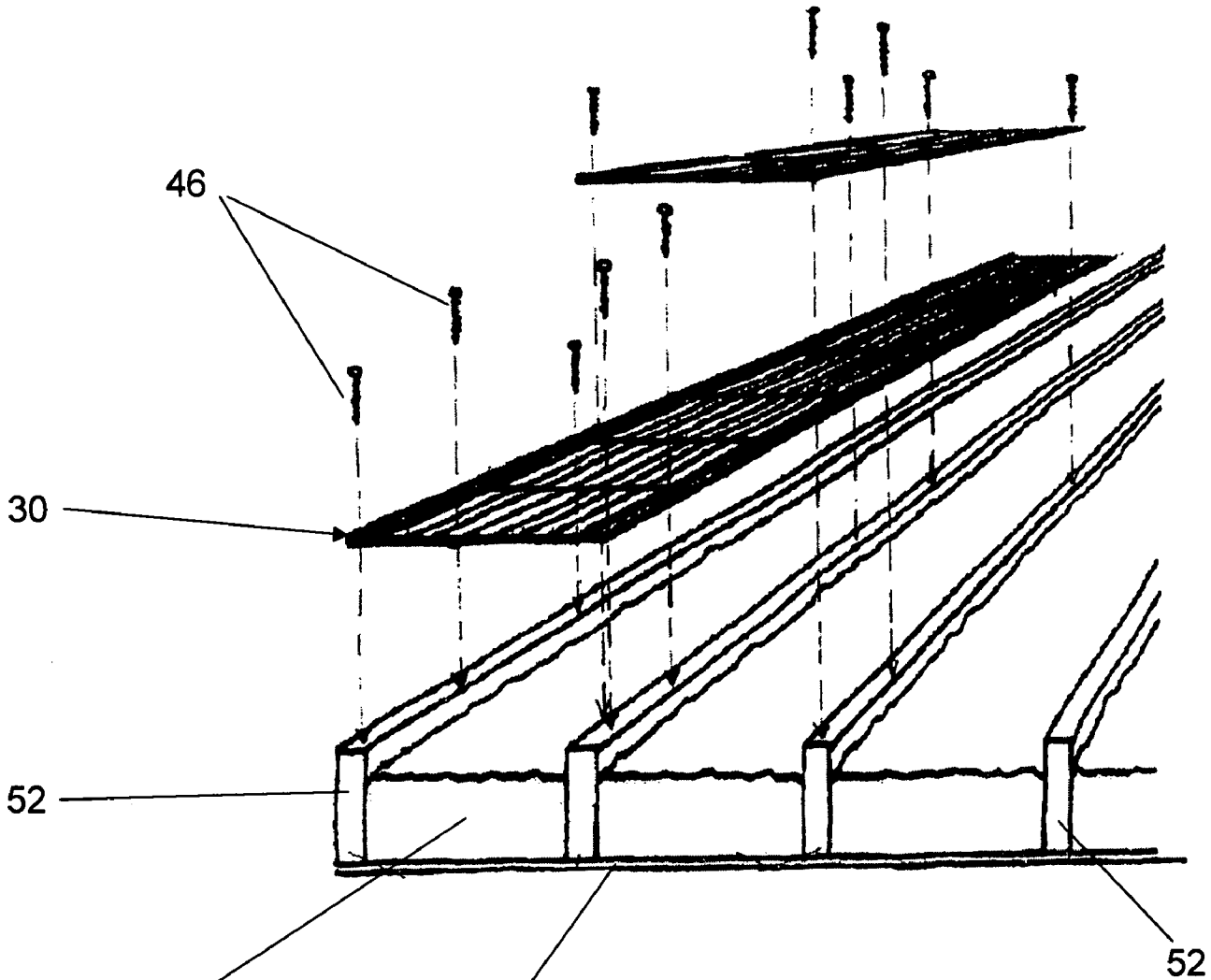
FIG. 7 is a sketch showing a typical installation of an Attic Grid System.

The FIG. 7 is a perspective sketch showing a typical installation of an Attic Grid System 30. Shown in this view is a preferred method of using a fastener 46 to connect the Attic Grid System 30 to the plurality of joists 52. These fasteners 46 would require simple tools such as a handheld driver, a hammer, or a powered driver for proper installation. Other means to fasten are described below in the description of operation. Further one notes in this view that the joists 52 have insulation material interspersed between the joists 52. This typical installation reinforces the need to have an open Attic Grid System 30 in order to prevent moisture entrapment and potential mold, mildew and eventual dry rot. In the simplest configuration as shown here, an Attic Grid System 30 panel is fastened directly to the joists. More panels are added until the size and amount of the desired storage space is achieved.

The FIG. 8 are photographs of alternative uses for an Attic Grid System 30. FIG. 8A shows an alternative placement 58 along a sidewall. Here the Attic Grid System 30 is fastened to the wall and prevents heavy objects 60 (here a stack of firewood) from engaging and gouging the sidewall. FIG. 8B shows another alternative placement as a ceiling 60. In this view the Attic Grid System 30 is placed below the joists and still fastened by some means 46 (not shown) to the joists 52.

Operation Of The Preferred Embodiment

The new Attic Grid System 30 has been described in the above embodiment. The manner of how the device operates is described below. Note well that the description above and the operation described here must be taken together to fully illustrate the concept of the Attic Grid System 30.

Using and installing the Attic Grid System 30 is fairly straight forward and is shown in TABLE C.

TABLE C

Installation of the Attic Grid System 30

| STEP | DESCRIPTION |
|---|---|
| 1 | Obtain the desired number of panels in the various sizes - Attic Grid System 31, 33, 35, 37, and 39 |
| 2 | Starting from either end of the floor joists, install the first Attic Grid 30 Floor Joist 52 run using a fastener 46. A joist run is two adjoining joist separated normally by a 16 inch or 24 inch spacing. |
| 3 | Repeat the process on the same joist 52 run with a second Attic Grid System 30 and fastener 46. |
| 4 | Continue this process until either the entire joist 52 run is covered w/the Attic Grids 30 or until one achieves the desired area covered. |
| 5 | If an Attic Grids 30 fit the space, use a shorter panel or trim with bolt cutters, a saw, or other simple tool. |
| 6 | After on joist 52 run is covered, start down the adjoining run and repeat the process. |
| 7 | Where necessary, trim the Attic Grid System 30 with bolt cutters, a saw, or other simple tool around mechanical and electrical objects. |

One skilled in the art understands that the drawings show essentially rectangular panels for the Attic Grid System 30. However, various other shapes of Grids (i.e., Squares, Diamonds, etc.) may be utilized within the scope of this invention.

There are many alternative uses for the Attic Grid System 30. The following are a few examples and not to be construed as a limitation to the system.

A. systems that are not possible with traditional wood and porous materials

B. support for porous insulation under crawl spaces

C. open ceiling areas (FIG. 8B).

D. side wall protection (FIG. 8A) for outbuildings w/exposed insulation in walls E. walk-ways that need to permit snow/water flow-through With this description it is to be understood that the Attic Grid System is not to be limited to the disclosed embodiment. The features of the Attic Grid System are intended to cover various modifications and equivalent arrangements included within the spirit and scope of the description.

What is claimed as new and desired to be protected by Letters Patent is:

1. An attic floor joist grid system for weight bearing storage, comprising:

a) a plurality of lateral primary bearing structures made of a five gauged high strength alloy steel wire;

b) a plurality of longitudinal primary bearing structures made of a five gauged high strength alloy steel wire;

c) at least two longitudinal secondary bearing structures made of a five gauged high strength alloy steel wire;

d) a means to connect all the bearing structures by spot welding the wires during manufacturing;

e) a means to attach the panels to the joists whereby the system is installable to the joists in residential and commercial buildings with simple tools and whereby the system results in a rigid and strong storage surface which permits air movement, moisture control, and strength in extreme temperatures.

2. An attic floor joist grid system for weight bearing storage, comprising:

(a) a plurality support panels comprising:

1) a plurality of lateral primary bearing structures consisting of deburred and powder-coated which is five gauged high strength allow steel wire;

2) a plurality of longitudinal primary bearing structures consisting of deburred and powder-coated which is five gauged high strength allow steel wire;

3) at least two longitudinal secondary bearing structures consisting of de-burred and powder-coated which is five gauged high strength allow steel wire; and 4) an interconnect means of spot welding all the wires at the point of intersection; and (b) a means to attach the support panels to the joists whereby the system is installable to the joists in residential and commercial buildings with simple tools and whereby the system results in a rigid and strong storage surface which permits air movement, moisture control, and strength in extreme temperatures.

* * * * *